US005676250A

United States Patent [19]

Walters

[11] Patent Number: 5,676,250

[45] Date of Patent: Oct. 14, 1997

[54] LIGHT STRING MOUNTING STORAGE SYSTEM

[76] Inventor: Darryl Kurt Walters, 4364 Schirmer St., St. Louis, Mo. 63116

[21] Appl. No.: 446,462

[22] Filed: May 22, 1995

[51] Int. Cl.[6] ..... B65D 85/42

[52] U.S. Cl. ..... 206/419; 206/226; 362/234; 362/249; 362/387

[58] Field of Search ..... 242/47, 125.1, 242/125.2, 118.3, 172, 407, 532, 532.6, 600; 206/419, 420, 813, 226, 388; 362/234, 238, 249, 252, 387, 391, 806; 174/135; 220/916; 224/251, 679, 680, 901.2, 901.6

[56] References Cited

U.S. PATENT DOCUMENTS

| | | | |
|---|---|---|---|
| 2,163,618 | 6/1939 | Muller | 242/118.3 |
| 3,967,795 | 7/1976 | Shindo et al. | 242/125.1 |
| 4,842,213 | 6/1989 | Bartschi et al. | 242/125.1 |
| 4,917,323 | 4/1990 | Wing | 242/96 |
| 5,016,145 | 5/1991 | Singleton | 362/80.1 |
| 5,142,461 | 8/1992 | Nugent | 362/252 |
| 5,381,899 | 1/1995 | Rabbitt | 206/419 |
| 5,388,802 | 2/1995 | Dougan et al. | 362/249 |

FOREIGN PATENT DOCUMENTS

| | | | |
|---|---|---|---|
| 253745 | 6/1926 | United Kingdom | 242/125.1 |

*Primary Examiner*—Alan Cariaso

[57] ABSTRACT

A system for storing a light string and removably coupling the light string to a building. The inventive device includes a hollow tube about which a light string can be wound for storage. Hook and loop fasteners secure the light string to an exterior of the tube and permit a removable coupling of the light string to a building during a holiday season.

15 Claims, 3 Drawing Sheets

10
14
16
18
22
24
26
28
30
12
16

3
3
14
28
18
22
20
30

Fig. 3
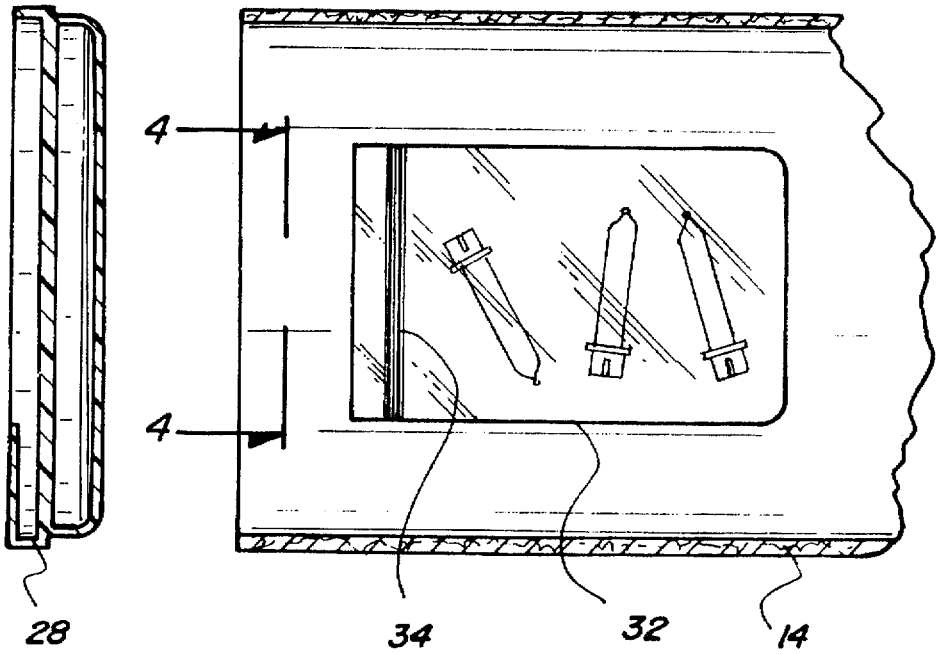
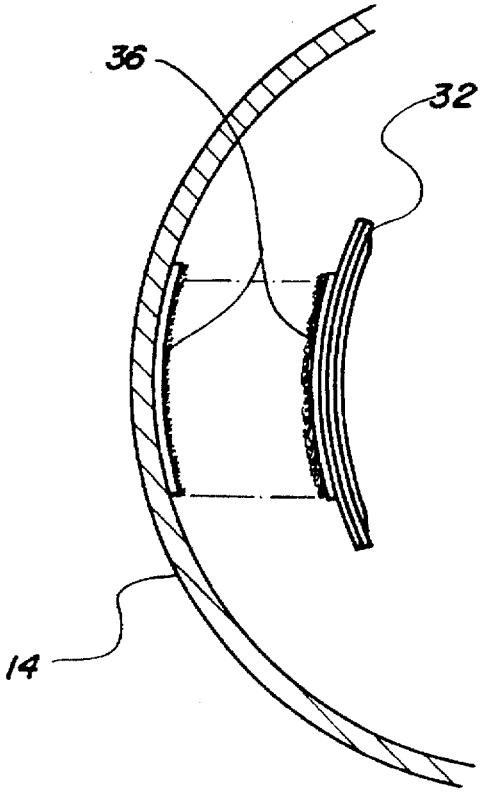
Fig. 4

LIGHT STRING MOUNTING STORAGE SYSTEM

BACKGROUND OF THE INVENTION

1. Related Data

The subject matter of the present utility patent application has been registered under the Disclosure Document Program at the United States Patent and Trademark Office. The request was received at the Patent Office on Nov. 9, 1993 and was assigned the Registration Number 342,616.

2. Field of the Invention

The present invention relates to light string devices and more particularly pertains to a light string mounting storage system for storing a light string and removably coupling the light string to a building.

3. Description of the Prior Art

The use of light string devices is known in the prior art. More specifically, light string devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art light string devices include U.S. Pat. No. 4,917,323; U.S. Pat. No. 5,142,461; U.S. Pat. No. 4,714,219; U.S. Pat. No. 5,024,406; U.S. Pat. No. 5,109,912; and U.S. Pat. No. 4,764,128.

While these devices fulfill their respective, particular objectives and requirements, the aforementioned patents do not disclose a light string mounting storage system for storing a light string and removably coupling the light string to a building which includes a hollow tube about which a light string can be wound for storage, with hook and loop fasteners securing the light string to an exterior of the tube and permitting a removable coupling of the light string to a building during a holiday season.

In these respects, the light string mounting storage system according to the present invention substantially departs from the conventional concepts and designs of the prior art, and in so doing provides an apparatus primarily developed for the purpose of storing a light string and removably coupling the light string to a building.

SUMMARY OF THE INVENTION

In view of the foregoing disadvantages inherent in the known types of light string devices now present in the prior art, the present invention provides a new light string mounting storage system construction wherein the same can be utilized for storing and removably coupling a light string to a building. As such, the general purpose of the present invention, which will be described subsequently in greater detail, is to provide a new light string mounting storage system apparatus and method which has many of the advantages of the light string devices mentioned heretofore and many novel features that result in a light string mounting storage system which is not anticipated, rendered obvious, suggested, or even implied by any of the prior art light string devices, either alone or in any combination thereof.

To attain this, the present invention generally comprises a system for storing a light string and removably coupling the light string to a building. The inventive device includes a hollow tube about which a light string can be wound for storage. Hook and loop fasteners secure the light string to an exterior of the tube and permit a removable coupling of the light string to a building during a holiday season.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light string mounting storage system apparatus and method which has many of the advantages of the light string devices mentioned heretofore and many novel features that result in a light string mounting storage system which is not anticipated, rendered obvious, suggested, or even implied by any of the prior art light string devices, either alone or in any combination thereof.

It is another object of the present invention to provide a new light string mounting storage system which may be easily and efficiently manufactured and marketed.

It is a further object of the present invention to provide a new light string mounting storage system which is of a durable and reliable construction.

An even further object of the present invention is to provide a new light string mounting storage system which is susceptible of a low cost of manufacture with regard to both materials and labor, and which accordingly is then susceptible of low prices of sale to the consuming public, thereby making such light string mounting storage systems economically available to the buying public.

Still yet another object of the present invention is to provide a new light string mounting storage system which provides in the apparatuses and methods of the prior art some of the advantages thereof, while simultaneously overcoming some of the disadvantages normally associated therewith.

Still another object of the present invention is to provide a new light string mounting storage system for storing a light string and permitting removable coupling of the light string to a building.

Yet another object of the present invention is to provide a new light string mounting storage system which includes a hollow tube about which a light string can be wound for storage, with hook and loop fasteners securing the light string to an exterior of the tube and permitting a removable coupling of the light string to a building during a holiday season.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken along line 3—3 of FIG. 2.

FIG. 4 is a cross-sectional view taken along line 4—4 of FIG. 3.

DESCRIPTION OF THE PREFERRED EMBODIMENT

Figure 1:
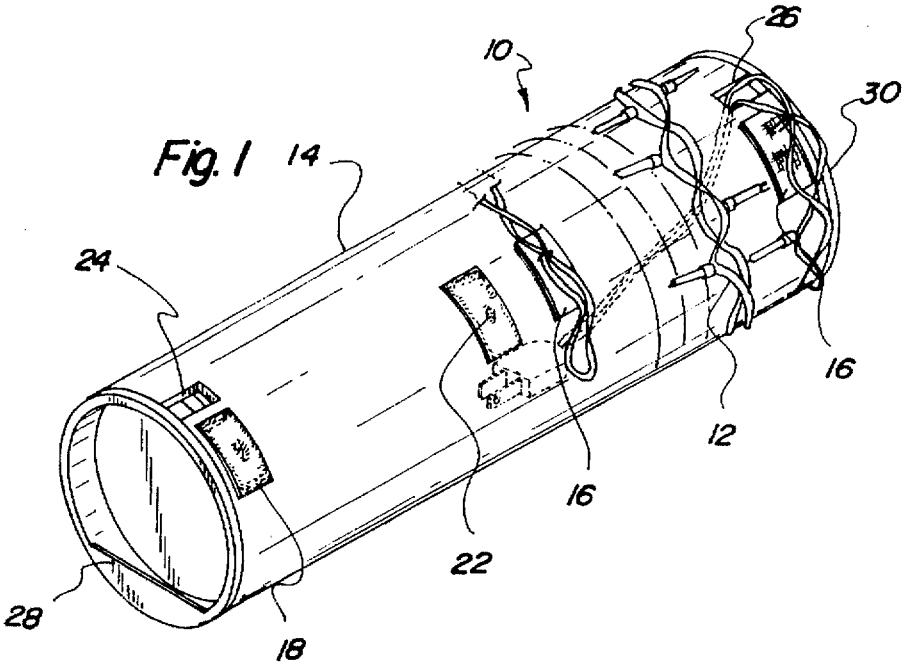
FIG. 1 is an isometric illustration of a light string mounting storage system according to the present invention.

With reference now to the drawings, and in particular to FIGS. 1–6 thereof, a new light string mounting storage system embodying the principles and concepts of the present invention and generally designated by the reference numeral 10 will be described.

More specifically, it will be noted that the light string mounting storage system 10 comprises a light string 12 of conventionally known construction having a plurality of light bulbs or other illumination devices thereon connected together by wires coupled to an electrical plug which can be engaged to a standard household outlet so as to cause illumination of the light bulbs thereof. A hollow tube 14 is provided with the present invention 10 and permits the light string 12 to be wound about an exterior of the hollow tube for storage. To couple the light string 12 to the exterior of the hollow tube 14, a plurality of wire portions 16 of hook and loop fabric fastening material are secured to the wires of the light string 12. Correspondingly shaped tube portions of hook and loop fabric fastening material are secured to an exterior of the hollow tube 14. By this structure, the wire portions 16 of fabric fastening material of the light string 12 can be removably coupled to the tube portions of hook and loop fabric fastening material secured to the hollow tube 14 so as to permit removable securement of the light string 12 in a spiral or helical fashion about an exterior of the hollow tube for storage.

Figure 2:
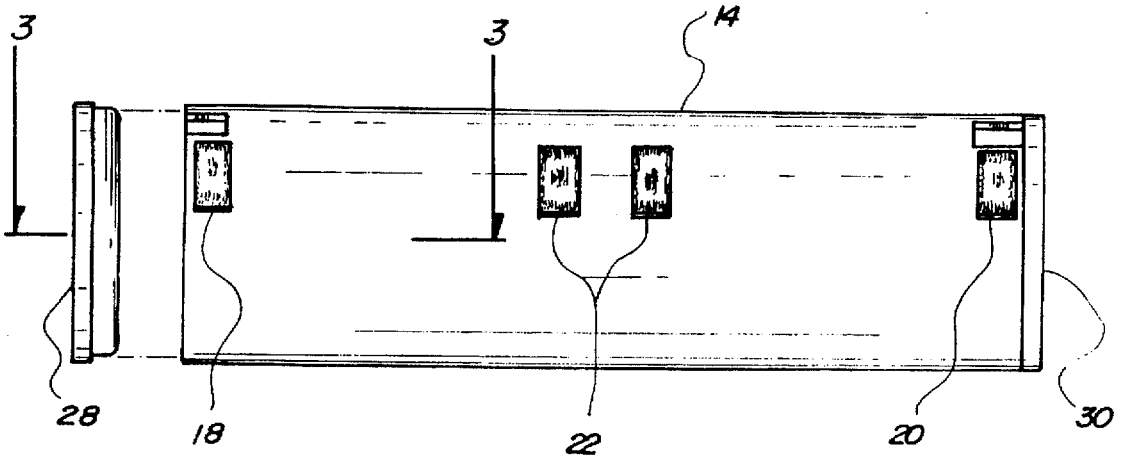
FIG. 2 is an elevation view of a hollow tube forming a portion of the present invention.

As best illustrated in FIGS. 1 and 2, it can be shown that the tube portions of fabric fastening material preferably comprise a first end portion 18 of fabric fastening material secured to an exterior of the hollow tube 14 proximal to a first end thereof. Similarly, a second end portion 20 of fabric fastening materials secured to the exterior of the hollow tube 14 proximal to a second end thereof. The tube portions of hook and loop fabric fastening material further comprise at least one central portion 22 of hook and loop fabric fastening material secured to an exterior of the hollow tube 14 proximal to a center portion thereof oriented medially between the end portions 18 and 20. By this structure, a first one of the wire portions 16 of fabric fastening material of the light string 12 can be coupled to an end portion 18 or 20 of the tube portions of fabric fastening materials secured to the hollow tube 14, with the light string 12 then being helically wrapped about the exterior of the hollow tube 14, with a last one of the wire portions 16 of fabric fastening material being secured to one of the central portion 22 of the tube portions of fabric fastening material secured to the exterior of the hollow tube 14.

With continuing reference to FIGS. 1 and 2, it can be shown that the hollow tube 14 may be shaped so as to define a first end notch 24 directed into a sidewall of the hollow tube 14. Similarly, a second end notch 26 may also be directed into a second end of the hollow tube 14. The present invention 10 may then further comprise a first end cap 28 removably coupled to the first end of the hollow tube 14 so as to substantially close the first end thereof, with a second end cap 30 being removably coupled to a second end of the hollow tube 14 so as to substantially close a second end. The end notches 24 and 26 thus operate to permit an insertion of a portion of the light string 12 into an interior of the hollow tube 14 for storage thereof. As shown in FIG. 1, a plug portion of the light string 12 can be positioned within the interior of the hollow tube 14, with a major portion of the light string 12 being wrapped about an exterior of the hollow tube 14 as shown. The end caps 28 and 30 are preferably frictionally retained within the respective ends of the hollow tube 14 so as to permit ease of insertion and removal thereof by an end user.

Referring now to FIGS. 3 and 4 of the drawings, it can be shown that the present invention 10 may further comprise a storage pouch 32 removably coupled to an interior of the hollow tube 14. The storage pouch 32 preferably includes a releasable closure 34 extending across an openable end thereof to permit objects such as spare light bulbs or the like to be removably stored within the pouch. The pouch 32 may comprise a conventionally known storage bag sold under the trademark name "ZIP-LOC" bag. To facilitate removable securement of the pouch 32 to an interior surface of the hollow tube 14, the present invention 10 employs interior portions 36 of hook and loop fabric fastening materials secured to both the pouch 32 and an interior surface of the hollow tube 14. By this structure, objects such as light bulbs or the like can be removably stored within the pouch 32 and positioned within the hollow tube 14 for storage thereof as desired by an end user.

Figure 5:
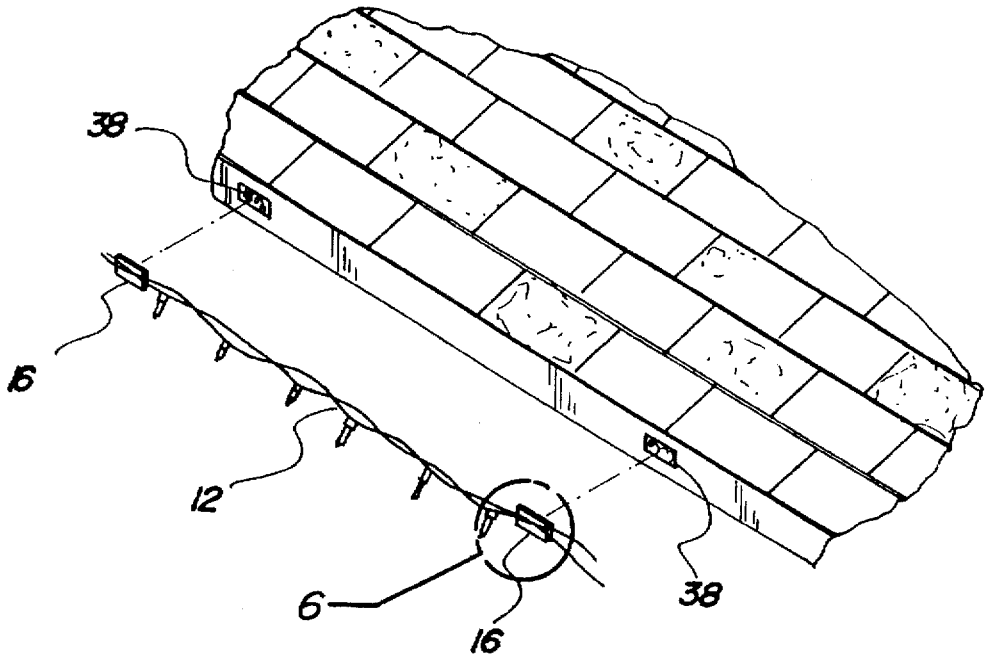
FIG. 5 is an exploded isometric illustration of the invention as coupled to a portion of a building.
Figure 6:
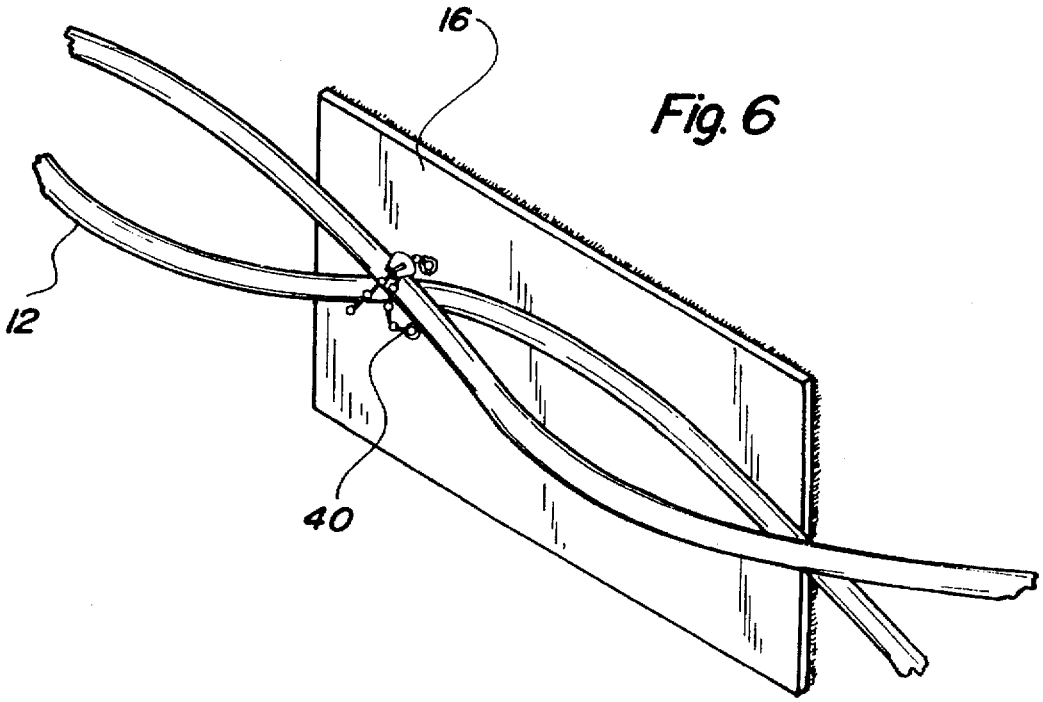
FIG. 6 is an enlarged isometric illustration of the area set forth in FIG. 5.

Referring now to FIGS. 5 and 6, it can be shown that the wire portions 16 of the hook and loop fabric fastening material which are secured to the light string 12 can be employed to couple the light string to an exterior of a building during a holiday season or other event. To this end, the present invention 10 further comprises building portions 38 of hook and loop fabric fastening material adapted for securement to a portion of a building as shown in FIG. 5 of the drawings. By this structure, the light string 12 can be decoupled from the hollow tube 14 and temporarily coupled to an exterior of a building through a cooperative securement of the wire portions 16 to the building portions 38 of the fabric fastening material.

As shown in FIG. 6, the wire portions 16 of the hook and loop fabric fastening material are preferably coupled to the wires of the light string 12 by a wire tie 40 extending through the wire portions 16 of fabric fastening material and secured about the wires of the light string 12.

In use, the light string mounting storage system 10 according to the present invention can be easily utilized to effect storage of the light string 12 during periods of non-use thereof, as well as to effect removable coupling of the light string 12 to an exterior portion of a building structure during a holiday season or other event. The present invention 10 thus solves a dual problem of both mounting and storage of conventionally known light strings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light string mounting storage system comprising:

a light string having a plurality of light bulbs connected together by wires, and an electrical plug coupled to the wires;

a hollow tube, the light string being wound about an exterior of the hollow tube;

a plurality of wire portions of hook and loop fabric fastening material secured to the wires of the light string;

a plurality of tube portions of hook and loop fabric fastening material secured to an exterior of the hollow tube, the wire portions of hook and loop fabric fastening material being secured the tube portions of hook and loop fabric fastening material.

2. The light string mounting storage system of claim 1, wherein the tube portions of fabric fastening material comprise a first end portion of fabric fastening material secured to an exterior of the hollow tube proximal to a first end thereof; a second end portion of fabric fastening materials secured to the exterior of the hollow tube proximal to a second end thereof; and at least one central portion of hook and loop fabric fastening material secured to an exterior of the hollow tube proximal to a center portion thereof oriented medially between the end portions.

3. The light string mounting storage system of claim 2, wherein the hollow tube is shaped so as to define a first end notch directed into a sidewall of the hollow tube, and a second end notch directed into a second end of the hollow tube, with the plug of the light string being positioned within the tube and a portion of the wires extending through one of the end notches.

4. The light string mounting storage system of claim 3, and further comprising a first end cap removably coupled to the first end of the hollow tube; a second end cap removably coupled to a second end of the hollow tube.

5. The light string mounting storage system of claim 4, and further comprising a storage pouch removably coupled to an interior of the hollow tube, the storage pouch including a releasable closure extending across an openable end thereof to permit objects to be removably stored within the pouch.

6. The light string mounting storage system of claim 5, wherein the pouch is removably secured within the hollow tube by interior portions of cooperative hook and loop fabric fastening material secured to both the pouch and an interior surface of the hollow tube.

7. The light string mounting storage system of claim 6, and further comprising building portions of hook and loop fabric fastening material adapted for securement to a portion of a building, wherein the light string can be decoupled from the hollow tube and coupled to an exterior of a building through a cooperative securement of the wire portions to the building portions of the fabric fastening material.

8. The light string mounting storage system of claim 7, wherein the wire portions of the hook and loop fabric fastening material are coupled to the wires of the light string by a wire tie extending through the wire portions of fabric fastening material and about the wires of the light string.

9. A light string mounting storage system comprising:

a hollow tube;

a plurality of tube portions of hook and loop fabric fastening material secured to an exterior of the hollow tube, and at least one end cap removably coupled to an end of the hollow tube, wherein the tube portions of fabric fastening material comprise a first end portion of fabric fastening material secured to an exterior of the hollow tube proximal to a first end thereof; a second end portion of fabric fastening materials secured to the exterior of the hollow tube proximal to a second end thereof; and at least one central portion of hook and loop fabric fastening material secured to an exterior of the hollow tube proximal to a center portion thereof oriented medially between the end portions.

10. A light string mounting storage system comprising a hollow tube; and a plurality of tube portions of hook and loop fabric fastening material secured to .an exterior of the hollow tube, wherein the tube portions of fabric fastening material comprise a first end portion of fabric fastening material secured to an exterior of the hollow tube proximal to a first end thereof; a second end portion of fabric fastening materials secured to the exterior of the hollow tube proximal to a second end thereof; and at least one central portion of hook and loop fabric fastening material secured to an exterior of the hollow tube proximal to a center portion thereof oriented medially between the end portions, and wherein the hollow tube is shaped so as to define a first end notch directed into a sidewall of the hollow tube, and a second end notch directed into a second end of the hollow tube.

11. The light string mounting storage system of claim 10, and further comprising a first end cap removably coupled to the first end of the hollow tube; a second end cap removably coupled to a second end of the hollow tube.

12. The light string mounting storage system of claim 11, and further comprising a storage pouch removably coupled to an interior of the hollow tube, the storage pouch including a releasable closure extending across an openable end thereof to permit objects to be removably stored within the pouch.

13. The light string mounting storage system of claim 12, wherein the pouch is removably secured within the hollow tube by interior portions of cooperative hook and loop fabric fastening material secured to both the pouch and an interior surface of the hollow tube.

14. A light string mounting storage system comprising:

a light string having a plurality of light bulbs connected together by wires, and an electrical plug coupled to the wires;

a plurality of wire portions of hook and loop fabric fastening material secured to the wires of the light string;

a building;

building portions of hook and loop fabric fastening material secured to a portion of the building, wherein the wire portions of the fabric fastening material of the light string are coupled to the building portions of the fabric fastening material.

15. The light string mounting storage system of claim 14, wherein the wire portions of the hook and loop fabric fastening material are coupled to the wires of the light string by a wire tie extending through the wire portions of fabric fastening material and about the wires of the light string.

* * * * *